US009539808B2

(12) United States Patent
Tamenaga et al.

(10) Patent No.: US 9,539,808 B2
(45) Date of Patent: Jan. 10, 2017

(54) LIQUID EJECTION HEAD

(71) Applicant: CANON KABUSHIKI KAISHA, Tokyo (JP)

(72) Inventors: Zentaro Tamenaga, Sagamihara (JP); Takuto Moriguchi, Kamakura (JP); Shuzo Iwanaga, Kawasaki (JP); Takatsugu Moriya, Tokyo (JP); Kazuhiro Yamada, Yokohama (JP); Akira Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/696,847

(22) Filed: Apr. 27, 2015

(65) Prior Publication Data

US 2015/0328894 A1 Nov. 19, 2015

(30) Foreign Application Priority Data

May 13, 2014 (JP) ..... 2014-099416
Apr. 8, 2015 (JP) ..... 2015-079170

(51) Int. Cl.
*B41J 2/14* (2006.01)

(52) U.S. Cl.
CPC ..... *B41J 2/14072* (2013.01); *B41J 2202/18* (2013.01); *B41J 2202/20* (2013.01)

(58) Field of Classification Search
CPC . B41J 2/14072; B41J 2202/20; B41J 2202/18; B41J 2/14; B41J 2/144
See application file for complete search history.

(56) References Cited

U.S. PATENT DOCUMENTS 6,609,786 B1 8/2003 Silverbrook et al.
6,659,591 B2 12/2003 Sato et al.
7,775,638 B2 8/2010 Hirosawa et al.
8,430,477 B2 4/2013 Sakata et al.
(Continued)

FOREIGN PATENT DOCUMENTS

CN 101688084 A 3/2010
CN 102083629 A 6/2011
(Continued)

OTHER PUBLICATIONS

U.S. Appl. No. 14/698,124, filed Apr. 28, 2015, Takatsugu Moriya, Kazuhiro Yamada, Zentaro Tamenaga, Takuto Moriguchi, Shingo Okushima, Akira Yamamoto.
(Continued)

*Primary Examiner* — Geoffrey Mruk
(74) *Attorney, Agent, or Firm* — Fitzpatrick, Cella, Harper & Scinto

(57) ABSTRACT

A liquid ejection head including a recording element substrate at one side portion of which an electrode is provided, an electric wiring board arranged opposing to the one side portion of the recording element substrate, a connecting member connecting the electrode provided at the one side portion of the recording element substrate to an electrode terminal provided on the electric wiring board, a sealing member formed across the one side portion of the recording element substrate and the electric wiring board so as to cover the connecting member, and a dummy sealing member provided so as to cover an opposite side portion on the side opposite to the one side portion of the recording element substrate.

15 Claims, 9 Drawing Sheets

(56) References Cited

U.S. PATENT DOCUMENTS

| | | | | |
|---|---|---|---|---|
| 8,678,556 | B2 | 3/2014 | Iwanaga et al. | |
| 9,067,413 | B2 | 6/2015 | Koseki | |
| 2010/0151231 | A1 | 6/2010 | Matsuo et al. | |
| 2010/0323192 | A1 | 12/2010 | Matsuo et al. | |
| 2010/0323193 | A1 | 12/2010 | Matsuo et al. | |
| 2011/0211024 | A1* | 9/2011 | Kawamura | B41J 2/14072 347/58 |
| 2015/0029265 | A1 | 1/2015 | Iwanaga et al. | |

FOREIGN PATENT DOCUMENTS

| | | | |
|---|---|---|---|
| CN | 103223778 | A | 7/2013 |
| JP | 4092688 | B2 | 5/2008 |
| JP | 2010-521343 | A | 6/2010 |

OTHER PUBLICATIONS

Office Action dated Jul. 6, 2016 in Chinese Patent Application No. 201510236612.5.

* cited by examiner

Prior Art

LIQUID EJECTION HEAD

BACKGROUND OF THE INVENTION

Field of the Invention

The present invention relates to a liquid ejection head for ejecting a liquid such as an ink.

Description of the Related Art

In recent years, an ink jet (IJ) printer has been used in not only household printing, but also commercial printing for business or retail photo, or industrial printing for electronic circuit drawing or panel display, and its use has been spread. A head of the IJ printer used in the commercial printing or the industrial printing is strongly required to be capable of printing at a high speed. In order to realize this requirement, it is frequently employed to drive a recording element generating energy for ejecting a liquid ink at a higher frequency or to provide a line head having a width longer than the width of a recording medium and a great number of ejection orifices.

PCT Japanese National Publication No. 2010-521343 discloses the construction of a long line head in which a plurality of recording element substrates are arranged in zigzag. In the construction in which the plural recording element substrates are arranged in zigzag, a recording element substrate having a parallelogram plane shape may be used in some cases for making the size of the head in a conveying direction of a recording medium small. In the invention disclosed in PCT Japanese National Publication No. 2010-521343, an electric wiring board is arranged at only a position opposing to one side portion of the recording element substrate, thereby attempting more miniaturization of the head. Examples of the electric wiring board include FPC (Flexible printed circuit) and TAB (Tape automated bonding).

The recording element substrate and the electric wiring board are electrically connected to each other with a connecting member such as, for example, a bonding wire to send or receive electric power or an electric signal. The connecting member is generally sealed and protected with a thermally curable resin for the purpose of preventing damage caused by external force or erosion caused by a liquid. When the connecting member is present at only one side portion of the recording element substrate and sealed with the resin, a sealing member composed of the resin is present at only one side portion.

In the invention disclosed in U.S. Pat. No. 6,609,786, a recording element substrate is mounted on an individual support member to fabricate a head module (unit), and a plurality of the head modules are arranged in a row to fabricate a long line head. The plane shape of each head module disclosed in U.S. Pat. No. 6,609,786 is rectangular, and the respective modules are diagonally inclined and arranged in such a manner that adjoining head modules overlap with each other in both a direction and a direction intersecting perpendicularly to the longitudinal direction to arrange the head modules at a high density.

In the liquid ejection head of the construction disclosed in PCT Japanese National Publication No. 2010-521343, in which the sealing member composed of the thermally curable resin for sealing the connecting member is formed at only one side portion of the recording element substrate, positional deviation of the recording element substrate may occur in some cases. The sealing member composed of the thermally curable resin is cured by heating. However, it is thereafter shrunk by cooling. Stress is generated upon shrinkage of the sealing member, and the positional deviation of the recording element substrate is caused by influence of the stress pulling the recording element substrate toward the side of the sealing member. When the recording element substrate deviates from an appropriate position, the impact position of a liquid ejected deviates, and so good recording cannot be conducted. This problem is similarly caused in such a line head having plural recording element substrates as disclosed in PCT Japanese National Publication No. 2010-521343 and even in what is called a serial type head in which a liquid is ejected while a small-sized liquid ejection head having only one recording element substrate is being moved. In particular, in such a line head that plural recording element substrates are arranged in a row as disclosed in PCT Japanese National Publication No. 2010-521343, the above-described problem is caused on the individual recording element substrates, and lowering of ejection accuracy (impact accuracy) due to lowering of relative positional accuracy between the recording element substrates is also caused. When such a liquid ejection head is employed in an ink jet printer, stripes or irregularities are caused on an image formed by liquid ejection to deteriorate image quality. In particular, formation of a very high-definition image has been conducted by an ink jet printer in recent years, so that it is desirable to eliminate even slight positional deviation of a recording element substrate which has heretofore not been taken into account so much. In addition, in the construction disclosed in PCT Japanese National Publication No. 2010-521343, the plural recording element substrates are installed on one long support structure, and so the whole head becomes unusable even if one of the plural recording element substrates becomes defective.

SUMMARY OF THE INVENTION

In order to solve the above problem, the present invention provides a liquid ejection head comprising a recording element substrate at one side portion of which an electrode is provided, an electric wiring board arranged opposing to the one side portion of the recording element substrate, a connecting member connecting the electrode provided at the one side portion of the recording element substrate to an electrode terminal provided on the electric wiring board, a sealing member formed across the one side portion of the recording element substrate and the electric wiring board so as to cover the connecting member, and a dummy sealing member provided so as to cover an opposite side portion on the side opposite to the one side portion of the recording element substrate.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1A:
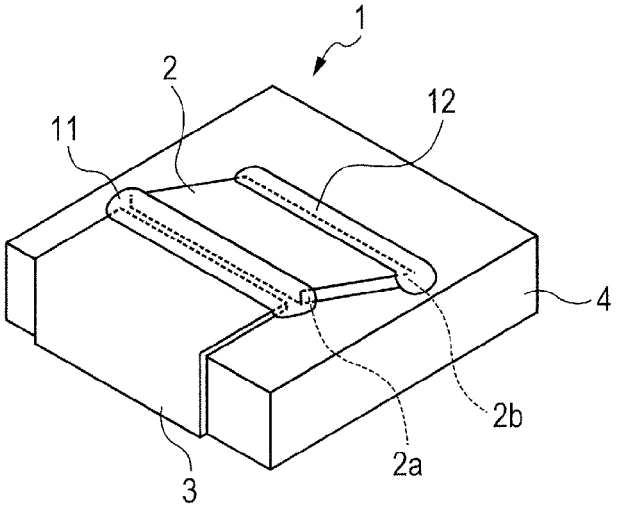
FIGS. 1A, 1B and 1C are a perspective view, a plan view and an enlarged sectional view illustrating a liquid ejection head according to a first embodiment of the present invention.
Figure 1B:
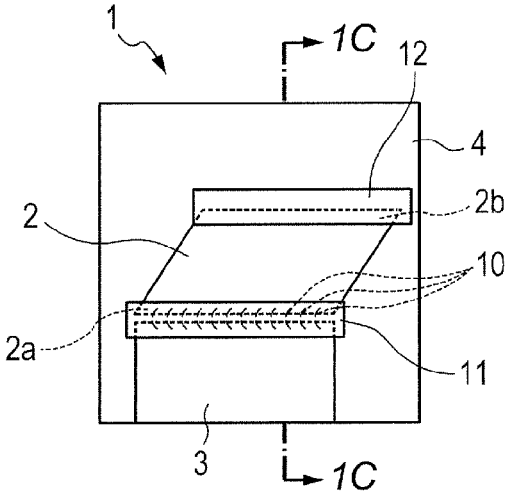
Figure 1C:
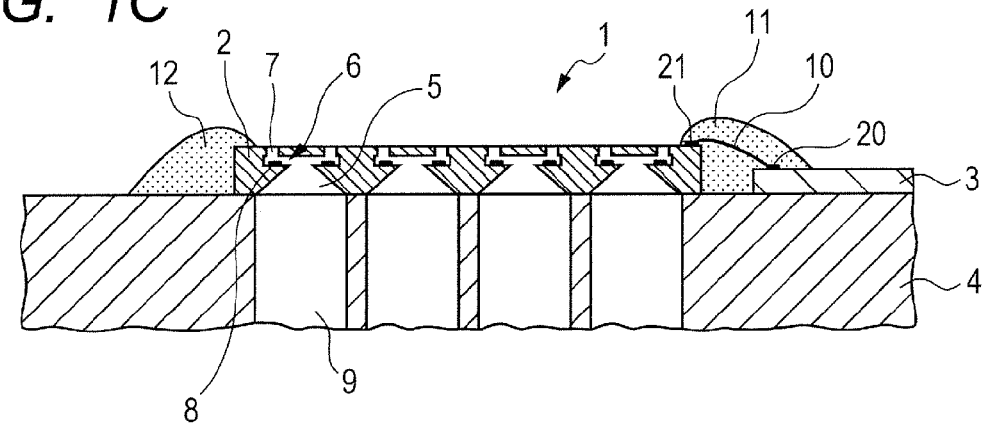

A liquid ejection head 1 according to the first embodiment of the present invention will be described with reference to FIGS. 1A to 1C. FIG. 1A is a perspective view of the liquid ejection head according to this embodiment, FIG. 1B is a plan view thereof, and FIG. 1C is a sectional view taken along line 1C-1C in FIG. 1B. This liquid ejection head 1 is a serial type small-sized head having a recording element substrate 2, an electric wiring board 3 and a support member 4. The recording element substrate 2 substantially has a parallelogram plane shape and also has a supply path 5 from which a liquid such as, for example, an ink is supplied, an energy-generating chamber 6 communicating with the supply path 5 and an ejection orifice 7 communicating with the energy-generating chamber 6 to open to the outside. A plurality of ejection orifices 7 are arranged so as to form a row. A recording element 8 for generating energy for ejecting a liquid is provided in the interior of each energy-generating chamber 6. That is, the energy-generating chamber 6 and the ejection orifice 7 are provided for each recording element 8. Examples of the recording element 8 include a heating element for generating heat and a piezoelectric element for generating pressure. In this embodiment, the recording element substrate 2 is provided with a Si substrate having the supply path 5 and the recording element 8 and with a resin ejection-orifice-forming member having the ejection orifice 7, and the energy-generating chamber 6 is formed at a joint portion between the substrate and the ejection orifice-forming member. Such a recording element substrate 2 is mounted on the support member 4. A plurality of introducing paths 9 through which a liquid flows are provided in the support member 4. Each of the introducing paths 9 communicates with the supply path 5 of the recording element substrate 2. The electric wiring board 3 is arranged on the surface of the support member 4 so as to oppose to one side portion 2*a* of the recording element substrate 2. An end side of one side portion 2*a* of the recording element substrate 2 closely opposes to an end side of the electric wiring board 3. An example of the electric wiring board is a flexible printed circuit (FPC). An electrode terminal 20 is electrically connected to an electrode 21 of the recording element substrate 2 through a connecting member 10 such as a bonding wire. The electric wiring board 3 is not limited to FPC, and TAB (tape automated bonding) may also be applied. In this case, the electrical connection to the recording element substrate 2 is electrically conducted through a lead wire extending from TAB. The electrode terminal 20 and the electrode 21 are omitted in FIGS. 1A and 1B, and the connecting member 10 is omitted in FIG. 1A. The connecting member 10 extends between the recording element substrate 2 and the electric wiring board 3. A sealing member (sealing material) 11 composed of a thermally curable resin is formed across one side portion 2*a* of the recording element substrate 2 and a part of the electric wiring board 3 for covering and protecting this connecting member 10. In addition, in this embodiment, a deformation-preventing member 12 covering an opposite side portion (another side portion) 2*b* on the side opposite to one side portion 2*a* of the recording element substrate 2 is provided. The deformation-preventing member 12 is favorably composed of the same resin as the sealing member 11.

In the liquid ejection head 1 according to this embodiment, a liquid is supplied to the energy-generating chamber 6 from the introducing path 9 of the support member through the supply path 5 of the recording element substrate 2 by virtue of such construction. When an electric drive signal is applied to the recording element 8 of the recording element substrate 2 from a control section (not illustrated) through the electric wiring board 3 and the connecting member 10, the recording element generates energy to eject the liquid within the energy-generating chamber 6 as a droplet from the ejection orifice 7 to the outside.

The technical significance of the deformation-preventing member 12 in this embodiment will now be described in detail. The present inventor has investigated the cause of the occurrence of the positional deviation of the recording element substrate 2 in such a conventional liquid ejection head 1 as described above to obtain the following knowledge.

Figure 2:
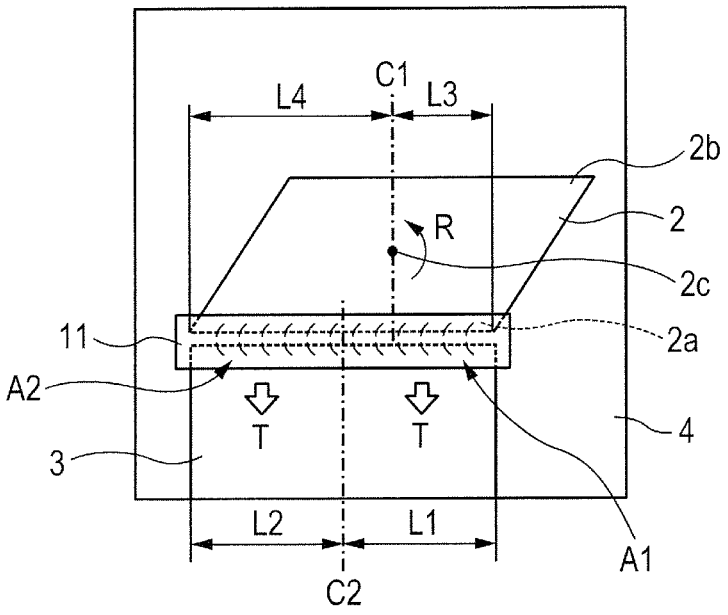
FIG. 2 is a plan view illustrating an example of a conventional liquid ejection head.

As illustrated in FIG. 2, the construction in which the electric wiring board 3 is arranged at only a position opposing to one side portion 2*a* of the recording element substrate 2 is used for miniaturizing the liquid ejection head 1. Electrodes 21 are intensively arranged at one side portion of the recording element substrate as described above, whereby the recording element substrate can be miniaturized. As a result, the liquid ejection head can be miniaturized. In this construction, the sealing member 11 for protecting the connecting member 10, which is an electrically connecting portion, is present at only one side portion 2*a*. Since the sealing member 11 is normally composed of a thermally curable resin, the sealing member 11 is applied so as to cover the connecting member 10 and then heated to be thermally cured and thereafter cooled. At this time, the sealing member 11 shrinks, and stress generated by this shrinkage is applied intensively to one side portion 2*a* of the recording element substrate 2, at which the sealing member 11 is provided. On the other hand, no stress is applied to the opposite side portion 2*b* on the side opposite to one side portion 2*a* of the recording element substrate 2 because neither the electrically connecting portion nor the sealing member is present. Since the stress is intensively applied to only one side portion 2*a* of the recording element substrate 2 and is not applied to the opposite side portion 2*b* as described above, the recording element substrate 2 is moved or deformed by the stress intensively applied to one side portion 2*a*, whereby great positional deviation of the recording element substrate 2 occurs to deteriorate the impact position accuracy of a liquid ejected from this liquid ejection head 1. Even when no positional deviation occurs, the recording element substrate may be broken, or the substrate constituting the recording element substrate may be separated from the ejection orifice-forming member in some cases. When this liquid ejection head 1 is used in an ink jet printer, such an influence that the accuracy recording by liquid ejection is deteriorated is exerted.

In this embodiment, the deformation-preventing member (dummy sealing member) 12 composed of a resin is thus arranged at the opposite side portion 2*b* of the recording element substrate 2. The deformation-preventing member 12 is also heat-cured at the same time when the sealing member 11 provided at the one side portion 2*a* is heat-cured and thereafter cooled. Accordingly, stress is also applied to the opposite side portion 2*b* by the cure shrinkage of the deformation-preventing member 12 at the same time when stress is applied to one side portion 2*a* by the cure shrinkage of the sealing member 11. The stress applied to the one side portion 2*a* by the cure shrinkage of the sealing member 11 is counterbalanced with the stress applied to the opposite side portion 2*b* by the cure shrinkage of the deformation-preventing member 12, whereby the occurrence of the deformation or positional deviation of the recording element substrate 2 is inhibited. According to this embodiment, only the one side portion 2*a* of the recording element substrate 2 is utilized for electrical connection as described above to attempt the miniaturization, and at the same time the stress concentration on the one side portion 2*a* of the recording element substrate 2 is inhibited, whereby the influence of the positional deviation can be inhibited. As a result, deviation of the impact position upon liquid ejection from the liquid ejection head can be inhibited. When this liquid ejection head is used in an ink jet printer, good recording can be conducted to obtain high recording quality.

In the liquid ejection head 1 according to this embodiment as described above, the support member 4 is required to have a low coefficient of linear expansion, high rigidity and high resistance to an ink. Accordingly, aluminum oxide or silicon carbide is favorable as a material of the support member 4. In the present invention, however, the material is not limited thereto, and the support member 4 may be composed of a resin material. In the case of the resin material, a filler may be contained in the material to make its coefficient of linear expansion low.

The sealing member 11 is composed of, for example, an epoxy resin, which is a thermally curable resin member, to mainly protect the connecting member 10 mechanically and chemically. Specifically, damage caused by external force or erosion caused by a liquid such as an ink is prevented. In the present invention, plural kinds of sealing members may also be applied. For example, a sealing member having a relatively low viscosity may be provided on the underside of the connecting member 10, and a sealing member having a relatively high viscosity may be provided on the upside thereof. The deformation-preventing member 12 is favorably composed of the same material as the sealing member 11. However, it may be formed with another material so far as its physical properties such as the coefficient of linear expansion and the elastic modulus are close to those of the sealing member.

The recording element substrate 2 is not limited to the parallelogram as illustrated in FIGS. 1A to 1C, and may have various plane shapes such as a square, a rectangle, a trapezoid, a trapezium and polygons other than the quadrangles. However, at least an end side of the one side portion 2*a* is favorably substantially linear.

Figure 3A:
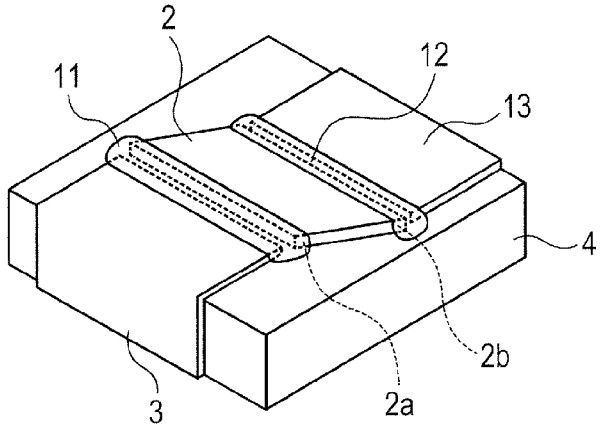
FIGS. 3A, 3B and 3C are a perspective view, a plan view and an enlarged sectional view illustrating a modified example of the liquid ejection head illustrated in FIGS. 1A to 1C.
Figure 3B:
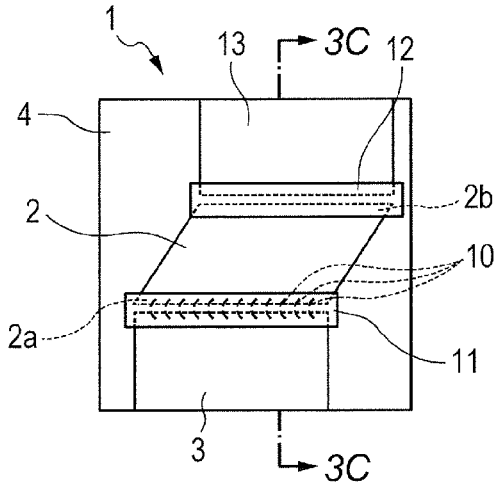
Figure 3C:
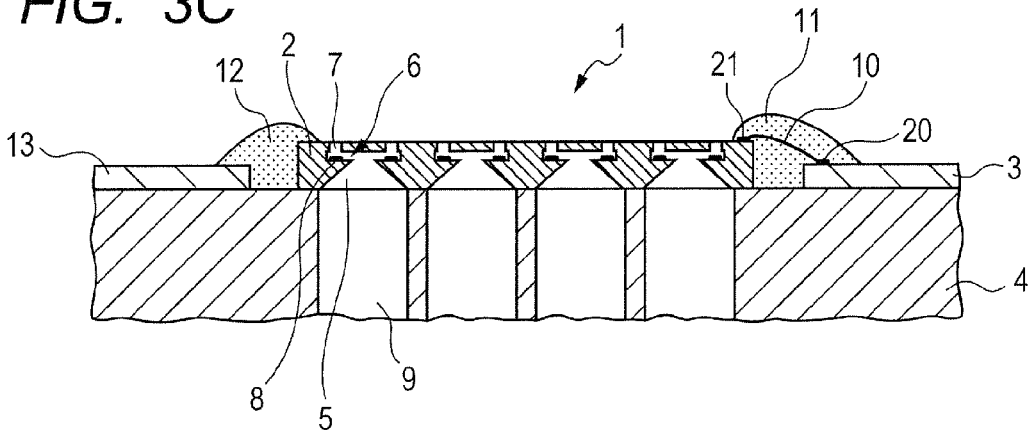

FIGS. 3A to 3C illustrate a modified example of the above-described embodiment. FIG. 3A is a perspective view of a liquid ejection head 1 according to this modified example, FIG. 3B is a plan view thereof, and FIG. 3C is a sectional view taken along line 3C-3C in FIG. 3B. In this modified example, a dummy substrate 13 is arranged at a position opposing to an opposite side portion 2*b* of a recording element substrate 2, and a deformation-preventing member 12 is arranged so as to span the opposite side portion 2*b* of the recording element substrate and the dummy substrate 13. The dummy substrate 13 has no electrode terminal, and no electrode is provided on the opposite side portion 2*b* of the recording element substrate 2. Other constructions are the same as the constructions illustrated in FIGS. 1A to 1C. In this modified example, only the one side portion 2*a* of the recording element substrate 2 is utilized for electrical connection to attempt the miniaturization. In addition, the stress applied to the one side portion 2*a* by the cure shrinkage of the sealing member 11 is counterbalanced with the stress applied to the opposite side portion 2*b* by the cure shrinkage of the deformation-preventing member 12, whereby the deformation or positional deviation of the recording element substrate 2 can be inhibited. Further, since the dummy substrate 13 similar to the electric wiring board 3 opposing to the one side portion 2*a* is arranged at the position opposing to the opposite side portion 2*b*, the shape of the deformation-preventing member 12 after curing is easier to retain. Still further, imbalance of weight or rigidity on the support member 4 is solved to more lessen a fear that the deformation or positional deviation of the recording element substrate 2 may occur. The dummy substrate 13 opposing to the opposite side portion 2*b* is favorably composed of the same material as the electric wiring board 3 opposing to the one side portion 2*a*. However, it may be formed with another material so far as its physical properties such as the coefficient of linear expansion and the elastic modulus are relatively close to those of the electric wiring board.

Figure 4A:
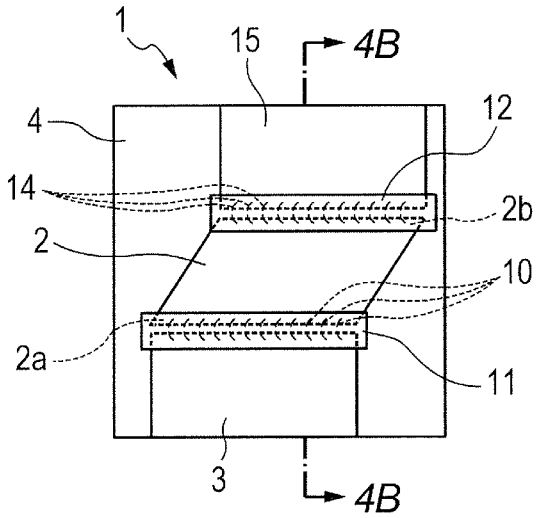
FIGS. 4A and 4B are a plan view and an enlarged sectional view illustrating another modified example of the liquid ejection head illustrated in FIGS. 1A to 1C.
Figure 4B:
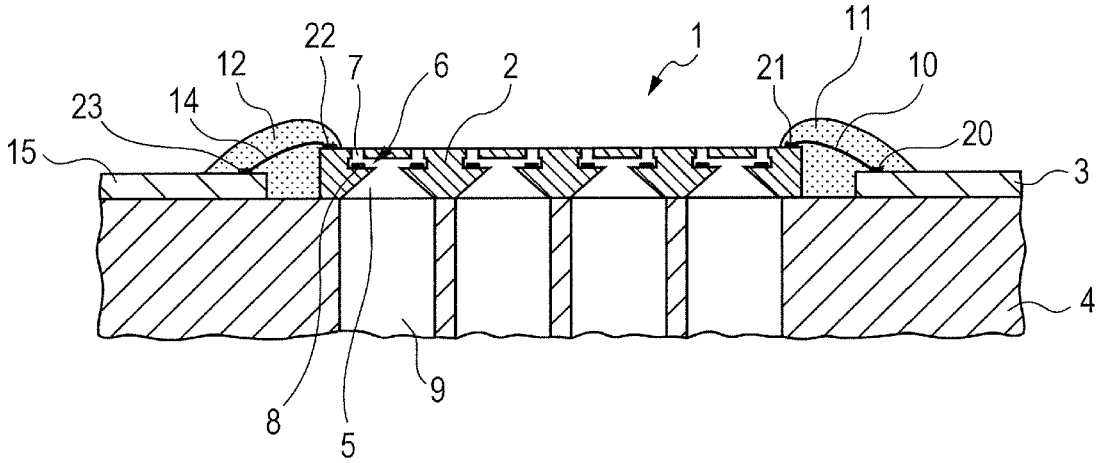

FIGS. 4A and 4B illustrate another modified example of the above-described embodiment. FIG. 4A is a plan view of a liquid ejection head 1 according to this modified example, and FIG. 4B is a sectional view taken along line 4B-4B in FIG. 4A. In this modified example, a connecting member 14 such as a bonding wire is arranged under the deformation-preventing member 12, and a dummy electric wiring board (opposite side electric wiring board) 15 is arranged at a position opposing to the opposite side portion 2*b* of the recording element substrate 2. In this modified example, an electrode 22 on the opposite side portion 2*b* of the recording element substrate 2 is electrically connected to an electrode terminal 23 on the opposite side electric wiring board 15 through the connecting member 14, and the connecting member 14 is covered with the deformation-preventing member 12. This dummy electric wiring board 15 is electrically connected to the recording element substrate 2 through the connecting member 14. However, this connection does not contribute to driving of the recording element substrate.

Even in this modified example, the stress is counterbalanced like the construction illustrated in FIGS. 3A to 3C, and imbalance of weight or rigidity due to the presence of the recording element substrate 2 on the support member is solved, and so the deformation or positional deviation of the recording element substrate 2 is hard to occur, and the shape of the deformation-preventing member 12 after curing is easy to retain. In addition, since not only the one side portion 2*a* of the recording element substrate 2 but also the opposite side portion 2*b* is utilized for electrical connection, so that the connecting member 14 for that can be mechanically and chemically protected by the deformation-preventing member 12, this modified example is favorable in that the symmetry of the stress is more improved. The opposite side electric wiring board 15 is favorably composed of the same material as the electric wiring board 3. However, it may be formed with another material so long as its physical properties such as the coefficient of linear expansion and the elastic modulus are relatively close to those of the electric wiring board.

Second Embodiment

Figure 5:
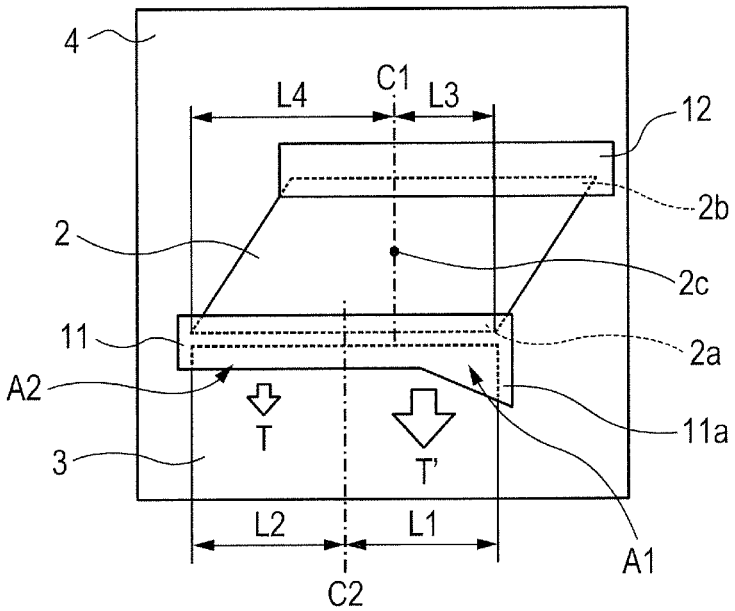
FIG. 5 is a plan view illustrating a liquid ejection head according to a second embodiment of the present invention.

A liquid ejection head according to the second embodiment of the present invention is illustrated in FIG. 5. In this embodiment, a sealing member 11 has a plane shape in which a projected portion 11*a* is added to a part of a rectangular form. Other constructions are the same as the constructions in the first embodiment. The technical significance of the plane shape of the sealing member 11 in this embodiment will now be described.

When the plane shape of the recording element substrate 2 is a substantial parallelogram like the prior art illustrated in FIG. 2, a perpendicular line C1 extending through a center 2*c* of gravity of the recording element substrate 2 and intersecting perpendicularly to an end side on the side of the one side portion 2*a* does not conform to a center line C2 in a direction of the end side in a sealed portion. That is, the perpendicular line C1 deviates from the center line C2 in an extending direction. The term "center line C2 in the sealed portion" as used herein means a line that extends through the center in the end side direction of a portion covered with the sealing member 11 in the end side of the one side portion 2*a* of the recording element substrate 2 and is parallel to the perpendicular line C1. Tensile stress T attending on the shrinkage of the sealing member 11 is generated substantially uniformly to both sides of the center line C2 in the sealed portion. However, since the perpendicular line C1 is different from the center line C2 in the sealed portion as described above, the stress does not act uniformly on both sides of the center 2*c* of gravity on the recording element substrate 2, but acts biasedly (in the example in FIG. 2, stress higher than on a right side acts on a left side of the center 2*c* of gravity). The stress T acting on the recording element substrate 2 is unbalanced between a region on the left side of the center 2*c* of gravity and a region on the right side of the center 2*c* of gravity, and so rotating force R is generated on the center 2*c* of gravity. As a result, there is a possibility that the recording element substrate 2 may be rotated on the support member 4 to cause positional deviation.

In other words, when two regions A1 and A2 (a region of a length L1 and a region of a length L2) divided by the center line C2 in the sealed portion in the portion where the one side portion 2*a* of the recording element substrate 2 is covered with the sealing member 11 have the same volume as each other, stress generated in the region A1 substantially conforms to stress generated in the region A2. If the center line C2 in the sealed portion conforms to the perpendicular line C1 extending through the center 2*c* of gravity of the recording element substrate, a region receiving the stress from the sealing member 11 on the right side of the center 2*c* of gravity is substantially equal in size to a region receiving the stress from the sealing member 11 on the left side of the center 2*c* of gravity. Accordingly, the stresses applied to both regions conform to each other, and so no rotating force is generated. However, when the center line C2 in the sealed portion is different from the perpendicular line C1, for example, a region receiving the stress from the sealing member 11 on the right side of the center 2*c* of gravity (a region of a length L3) is smaller than a region receiving the stress from the sealing member 11 on the left side of the center 2*c* of gravity (a region of a length L4). The magnitudes of the stresses applied to these two regions vary according to a difference between the sizes of the respective regions. Thus, the difference between the stresses on the left and right sides of the center 2*c* of gravity generates the rotating force R.

In this embodiment, thus, the sealing member 11 is formed in such a manner that the plane shape of the sealing material 11 becomes asymmetric, thereby inhibiting the generation of the rotating force R. Specifically, the sealing member has been formed in such a manner that the volume of the region A1 through which the perpendicular line C1 extending through the center 2*c* of gravity of the recording element substrate 2 in the portion where the one side portion 2*a* of the recording element substrate 2 is covered with the sealing member 11 extends becomes larger than the volume of the region A2 through which the perpendicular line C1 does not extend. At this time, both volumes are changed by providing the projected portion 11*a* in the region A1 while the length L1 of the region A1 and the length L2 of the region A2 are caused to conform to each other, whereby the tensile stress T' generated in the region A1 becomes higher than the tensile stress T generated in the region A2. As a result, the stress acting on the region on the left side of the center 2*c* of gravity balances with the stress acting on the region on the right side of the center 2*c* of gravity in the recording element substrate 2.

That is, when viewed with the center line C2 in the sealed portion as a center, the stress T' acting on the region A1 on one side is made higher than the stress T acting on the region A2 on the other side by changing the volumes of the regions A1 and A2 of the portion where the one side portion 2*a* of the recording element substrate 2 is covered with the sealing member 11. When viewed the center 2*c* of gravity of the recording element substrate 2 as a center, the stress acting on a small region on one side of the recording element substrate 2 (a region indicated by the length L3) is thereby caused to substantially conform to the stress acting on a large region on the other side (a region indicated by the length L4). As a result, no force of rotating on the center 2*c* of gravity acts on the recording element substrate 2. In this manner, it is intended not to cause the positional deviation due to the rotation of the recording element substrate 2. The difference between the volumes of the region A1 and the region A2 is set in such a manner that the stresses acting on both regions (the portion of the length L3 and the portion of the length L4) substantially conform to each other taking a size difference between the small regions on one side and the large region on the other side in the recording element substrate 2 (a difference between the length L3 and the length L4) into consideration. Specifically, when the portion where the one side portion 2*a* of the recording element substrate 2 is covered with the sealing member 11 is divided into two regions by the perpendicular line C1 extending through the center 2*c* of gravity of the recording element substrate 2, the volumes of these two regions are favorably equal to each other. When the two regions divided by the perpendicular line C1 in the portion where the one side portion 2*a* of the recording element substrate 2 is covered with the sealing member 11 have the same volume as each other, stresses of the same magnitude act on both sides of the center 2*c* of gravity of the recording element substrate 2. Accordingly, no force of rotating on the center 2*c* of gravity is generated in the recording element substrate 2. However, even when the volumes of these both regions do not strictly conform, an effect to prevent the positional deviation due to the rotation is achieved to some extent because the force of rotating on the center 2*c* of gravity is low if a difference between the volumes of both regions is small.

As described above, the volumes of the two regions A1 and A2 of the portion where the one side portion of the recording element substrate 2 is covered with the sealing member 11 are controlled, whereby the effect to prevent the positional deviation due to the rotation is more enhanced in addition to the prevention of the positional deviation by the deformation-preventing member 12 like the first embodiment.

Figure 6A:
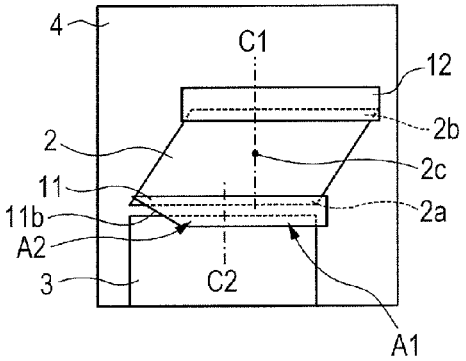
FIGS. 6A, 6B, 6C, 6D and 6E are plan views illustrating various modified examples of the liquid ejection head illustrated in FIG. 5.

FIG. 6A illustrates a first modified example of the embodiment of the invention. In this modified example, the sealing member 11 has a plane shape in which a cutout portion (a depressed portion) 11*b* is provided in a rectangle. Specifically, the cutout portion 11*b* is partly formed at an end portion on the side of the region A2 of the sealing member 11 through which the perpendicular line C1 does not extend, whereby the volume of the region A1 through which the perpendicular line C1 extends becomes larger than the volume of the region A2 through which the perpendicular line C1 does not extend. As a result, a high positional deviation-preventing effect is achieved like the construction illustrated in FIG. 5.

Figure 6D:
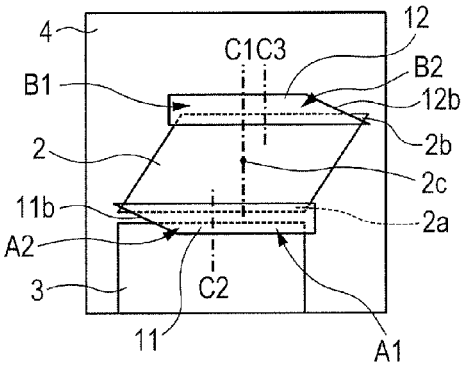
Figure 6B:
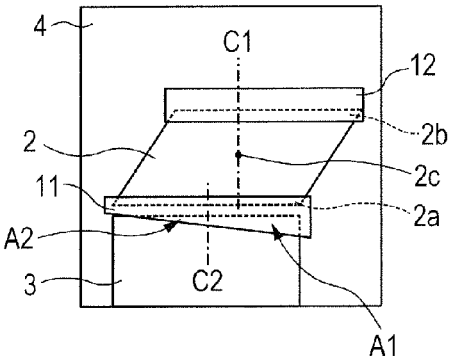

FIG. 6B illustrates a second modified example of the embodiment of the invention. In this modified example, the plane shape of the sealing member 11 is a laterally-extending trapezoid which becomes continuously large from the side of the region A2 through which the perpendicular line C1 does not extend toward the side of the region A1 through which the perpendicular line C1 extends. According to this construction, the volume of the region A1 through which the perpendicular line C1 extends can become sufficiently larger than the volume the region A2 through which the perpendicular line C1 does not extend without providing a bigger projected portion 11*a* or depressed portion 11*b*, so that the effect to prevent the positional deviation due to the rotation is easily achieved.

Figure 6E:
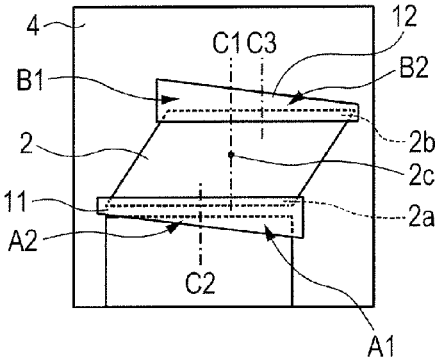
Figure 6C:
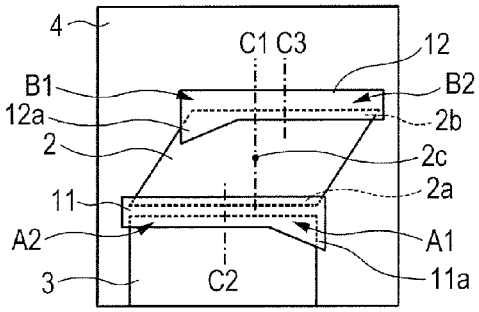

FIG. 6C illustrates a third modified example of the embodiment of the invention. In this modified example, of two regions B1 and B2 which are divided by a center line C3 in a deformation-prevented portion in a portion where the opposite side portion 2*b* of the recording element substrate 2 is covered with the deformation-preventing member 12, the volume of a region B1 through which the perpendicular line C1 extends becomes larger than the volume of the region B2 through which the perpendicular line C1 does not extend. As a result, a higher positional deviation-preventing effect than the construction illustrated in FIG. 5 is achieved. Conversely, if the projected portion 11*a* is made small, a sufficient rotational movement-preventing effect is achieved by providing the same projected portion 12*a* at the deformation-preventing member 12. The sealing member 11 and the deformation-preventing member 12 are favorably point-symmetrical (rotation-symmetrical) with the center 2*c* of gravity of the recording element substrate 2 as a symmetrical point. Incidentally, the term "center line C3 in the deformation-prevented portion" as used herein means a line that extends through the center of a portion covered with the deformation-preventing member 12 in the end side of the opposite side portion 2*b* of the recording element substrate 2 and is parallel to the perpendicular line C1.

FIG. 6D illustrates a fourth modified example of the embodiment of the invention. This modified example is a combination of the first modified example illustrated in FIG. 6A with the third modified example illustrated in FIG. 6C. That is, the sealing member 11 has the cutout portion 11*b*, and the deformation-preventing member 12 also has a cutout portion 12*b*, whereby of two regions B1 and B2 which are divided by the center line C3 in the deformation-prevented portion in the portion where the opposite side portion 2*b* of the recording element substrate 2 is covered with the deformation-preventing member 12, the volume of the region B1 through which the perpendicular line C1 extends becomes larger than the volume of the region B2 through which the perpendicular line C1 does not extend. A high positional deviation-preventing effect is achieved like the third embodiment. The sealing member 11 and the deformation-preventing member 12 are favorably point-symmetrical (rotation-symmetrical) with the center 2*c* of gravity of the recording element substrate 2 as a center.

FIG. 6E illustrates a fifth modified example of the embodiment of the invention. This modified example is a combination of the second modified example illustrated in FIG. 6B with the third modified example illustrated in FIG. 6C. That is, the sealing member has a laterally-extending trapezoid whose area becomes continuously large, and the deformation-preventing member 12 has a laterally-extending trapezoid whose area becomes continuously large toward a direction opposite to the area increasing direction of the sealing member 11, whereby the volume of the region B1 through which the perpendicular line C1 extends in the portion where the opposite side portion 2*b* of the recording element substrate 2 is covered with the deformation-preventing member 12 becomes larger than the volume of the region B2 through which the perpendicular line C1 does not extend. Even in this modified example, a high positional deviation-preventing effect is achieved like the third embodiment. The sealing member 11 and the deformation-preventing member 12 are favorably point-symmetrical (rotation-symmetrical) with the center 2*c* of gravity of the recording element substrate 2 as a center.

Third Embodiment

Figure 7A:
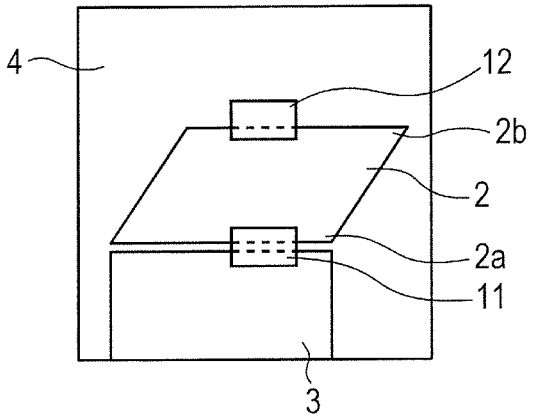
FIGS. 7A and 7B are plan views illustrating a liquid ejection head according to a third embodiment of the present invention.

In the first and second embodiments described above, the lengths of the sealing member 11 and deformation-preventing member 12 in a direction parallel to the end sides of the one side portion 2*a* and the opposite side portion 2*b* of the recording element substrate 2 are substantially equal to the lengths of their end sides. In the third embodiment illustrated in FIGS. 7A and 7B, however, the sealing member 11 of a small size and the deformation-preventing member 12 are provided. In this construction, the connecting members 10 (see FIGS. 1B and 1C) necessary for the electrical connection of the recording element substrate 2 to the electric wiring board 3 are arranged at a high density, the sealing member 11 of the minimum size necessary for covering those connecting members 10 is provided, and the deformation-preventing member 12 of the same size as that of the sealing member 11 of the small size is provided. In this embodiment, stress generated by the cure shrinkage of the sealing member is low because the sealing member 11 is small, and so the effect to prevent the positional deviation is easy to achieve.

Figure 7B:
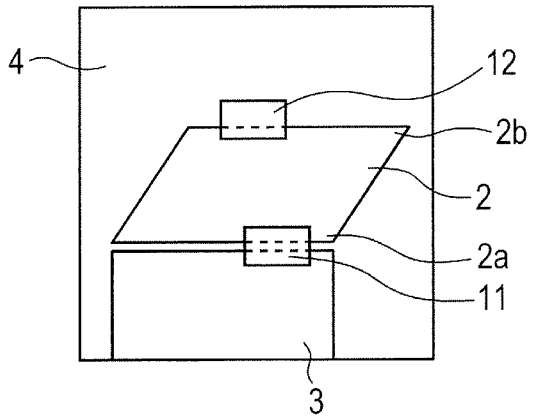

In the construction illustrated in FIG. 7B in particular, the sealing member 11 is arranged at a biased position in a direction along the end side of the one side portion 2*a* of the recording element substrate 2, and the deformation-preventing member 12 is arranged at a biased position on the opposite side to the sealing member 11, thereby inhibiting the rotating force from acting on the recording element substrate 2 to inhibit the positional deviation.

Fourth Embodiment

Figure 8A:
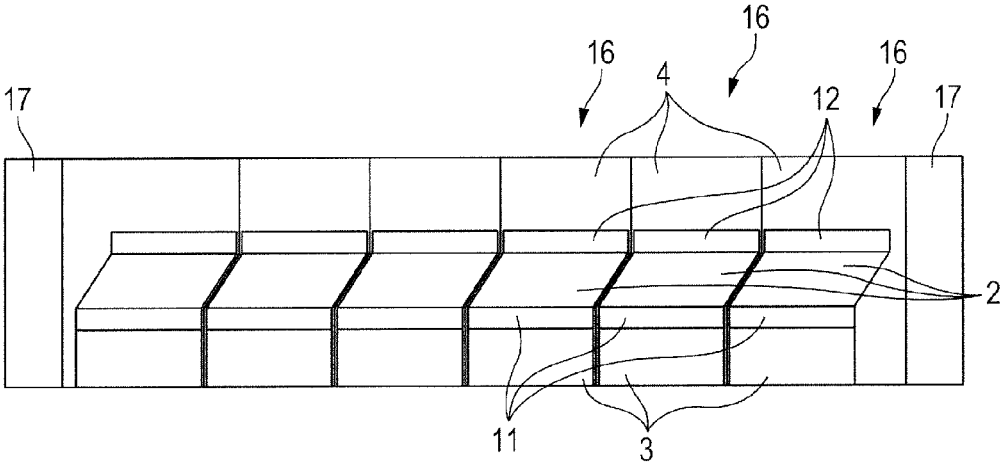
FIGS. 8A and 8B are plan views illustrating a liquid ejection head according to a fourth embodiment of the present invention.
Figure 8B:
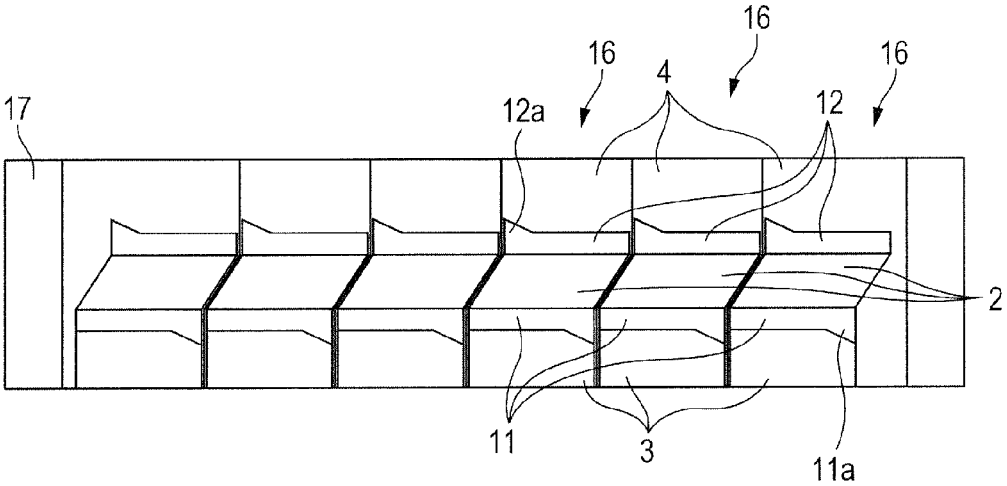

The first to third embodiments described above relate to the serial type small-sized liquid ejection head. In this embodiment, however, the present invention is adopted in a long line head. In this embodiment, as illustrated in FIGS. 8A and 8B, a plurality of units (head modules) 16 in each of which the recording element substrate 2, the electric wiring board 3, the connecting member 10 and the sealing member 11 are arranged on the support member 4 are arranged in a row on a long support member 17. A plurality of recording element substrates 2 are closely arranged. The construction of each unit is any one of the constructions described in the first to third embodiments. FIG. 8A illustrates the same unit as the construction illustrated in FIGS. 1A to 1C, and FIG. 8B illustrates the same unit as the construction illustrated in FIG. 6C. As described above, the detailed construction of each unit 16 may be any one of the constructions illustrated in FIGS. 1A to 7B.

Figure 9A:
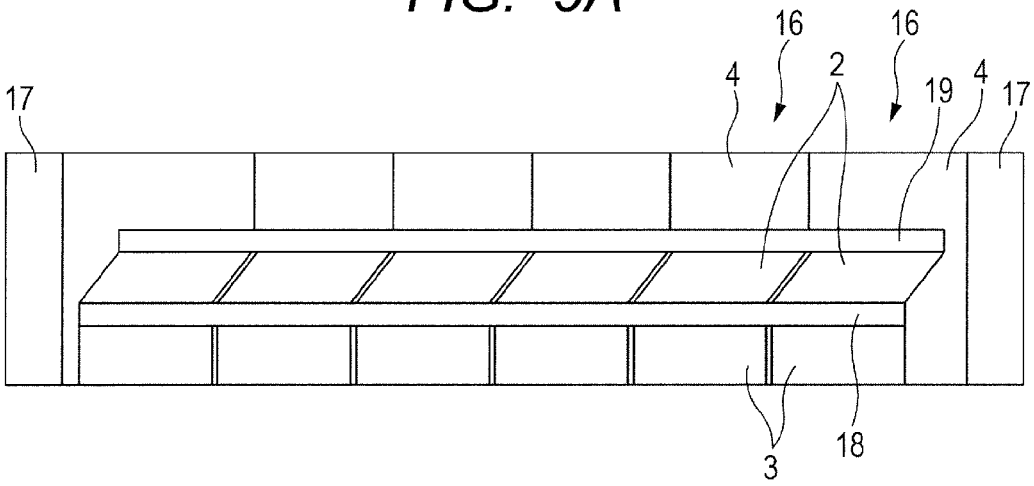
FIGS. 9A and 9B are plan views illustrating various modified examples of the liquid ejection head illustrated in FIGS. 8A and 8B.

In a modified example illustrated in FIG. 9A, a plurality of support members 4 are closely arranged in a row on one long support member 17, and one long sealing member 18 and one long deformation-preventing member 19 are provided across all the support members 4. The sealing member 18 collectively covers the one side portions 2*a* of all the recording element substrates 2 and opposing portions of all the electric wiring boards 3. Likewise, the long deformation-preventing member 19 collectively covers the opposite side portions 2*b* of all the recording element substrates 2. In this construction, the one side portions 2*a* of the plural recording element substrates 2 are covered with one sealing member 18, and the opposite side portions are covered with one deformation-preventing member 19, so that it is difficult to independently move (rotate) the individual recording element substrates. Accordingly, the effect to prevent the positional deviation becomes high. In addition, since a process of forming the sealing member 18 and the deformation-preventing member 19 is completed at one time, the operation thereof is simple. Further, since variation in positional deviation between the respective recording element substrates 2 is small, the relative positional accuracy between the respective recording element substrates 2 is easily adjusted, and the adjusting operation thereof is simple.

Figure 9B:
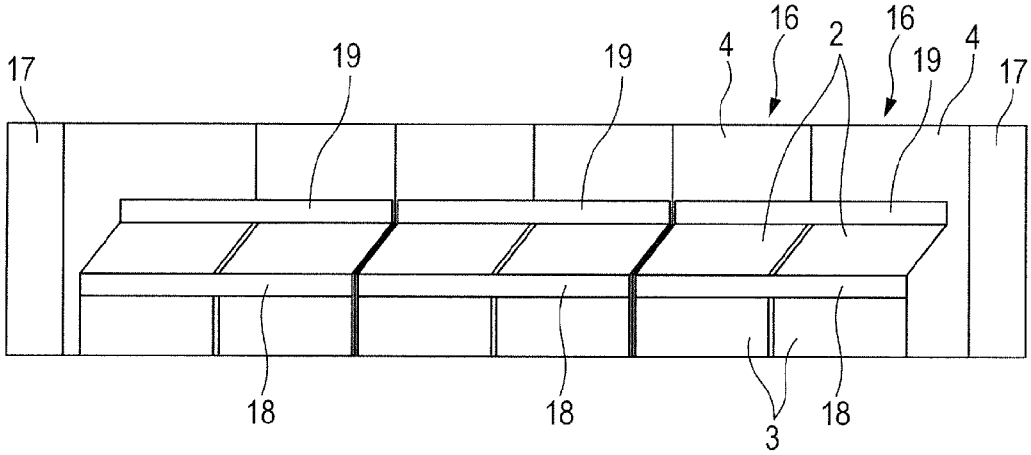

Like another modified example illustrated in FIG. 9B, at least two adjoining recording element substrates 2 may be regarded as one group to provide one sealing member and one deformation-preventing member 12 to the recording element substrates in each group. In the example illustrated in FIG. 9A, all the recording element substrates 2 are collectively covered with one sealing member 11 and one deformation-preventing member 12. In the example illustrated in FIG. 9B, the recording element substrates 2 are divided into plural groups, and one sealing member 11 and one deformation-preventing member 12 are provided to each group. Selection of either one of these modified examples may be determined by taking ease of production and a positional deviation-preventing effect into consideration on the basis of the size of the whole liquid ejection head 1.

In the second to fourth embodiments illustrated in FIGS. 5 to 9B, the construction in which the dummy substrate 13 is provided at a position opposing to the opposite side portion 2*b* of the recording element substrate or in which the opposite side electric wiring board 15 and the connecting member 14 are provided may also be adopted like the modified examples of the first embodiment illustrated in FIGS. 3A to 3C, 4A and 4B.

According to the present invention, the positional deviation of the recording element substrate in the liquid ejection head can be inhibited as described above, thereby improving the impact position accuracy of a droplet ejected. Accordingly, when this liquid ejection head is adopted in an ink jet printer, high recording quality can be stably achieved even upon high-speed printing.

In addition, when plural recording element substrates are arranged to fabricate a line head, the positional deviation of the individual recording element substrates can be inhibited. Further, the relative positional deviation between the recording element substrates can be made small, and the relative positions between the recording element substrates can be easily adjusted to improve operation efficiency. Stripes or irregularities in a recorded image caused by the relative positional deviation between the recording element substrates can be thereby prevented to prevent recording quality from being deteriorated. In addition, in the above-described respective embodiments, such a structure of the electric wiring board 3 as to extend in the form of a belt from a side of the recording element substrate 2 is described. However, the present invention is not limited thereto. For example, the present invention can be applied to a liquid ejection head of the construction in which an opening is provided in the electric wiring board 3, and the recording element substrate 2 is arranged within the opening to electrically connect the recording element substrate to the electric wiring board through an inner edge of the opening.

According to the present invention, the sealing member and the deformation-preventing member are provided, whereby the stress concentration only on the one side portion of the recording element substrate can be avoided, so that the positional deviation of the recording element substrate can be inhibited. As a result, lowering of impact accuracy of a liquid ejected from this liquid ejection head is inhibited. Accordingly, when this liquid ejection head is used in an ink jet printer, high-quality printing can be conducted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-099416, filed May 13, 2014, and Japanese Patent Application No. 2015-079170, filed Apr. 8, 2015, which are hereby incorporated by reference herein in their entirety.

What is claimed is:

1. A liquid ejection head comprising a recording element substrate at one side portion of which an electrode is provided, an electric wiring board arranged opposing to the one side portion of the recording element substrate, a connecting member connecting the electrode provided at the one side portion of the recording element substrate to an electrode terminal provided on the electric wiring board, a first sealing member formed across the one side portion of the recording element substrate and the electric wiring board so as to cover the connecting member, and a second sealing member provided so as to cover an opposite side portion on the side opposite to the one side portion of the recording element substrate, wherein no electrode is formed on the opposite side portion of the recording element substrate.

2. The liquid ejection head according to claim 1, wherein the first sealing member and the second sealing member are formed with the same material.

3. The liquid ejection head according to claim 1, further comprising a support member on which the recording element substrate is mounted to support the recording element substrate, wherein at least a part of the electric wiring board is located on the support member, and the second sealing member is formed across the opposite side portion of the recording element substrate and the support member.

4. The liquid ejection head according to claim 1, further comprising another substrate arranged opposing to the opposite side portion of the recording element substrate, wherein the second sealing member is formed across the opposite side portion and the other substrate.

5. The liquid ejection head according to claim 4, further comprising a support member on which the recording element substrate is mounted to support the recording element substrate, wherein at least a part of the electric wiring board and at least a part of the other substrate are each located on the support member.

6. The liquid ejection head according to claim 1, wherein the recording element substrate has an ejection orifice for ejecting a liquid and a recording element which generates energy for ejecting the liquid from the ejection orifice, and the electrode is electrically connected to the recording element.

7. The liquid ejection head according to claim 1, wherein the recording element substrate has a parallelogram plane shape, a line extending through a center of gravity of the recording element substrate and perpendicularly intersecting an end side of the one side portion and a center line in an extending direction of the end side of the one side portion deviate from each other in the extending direction.

8. The liquid ejection head according to claim 1, wherein a perpendicular line extending through a center of gravity of the recording element substrate and perpendicularly intersecting an end side of the one side portion of the recording element substrate is different from a sealed portion center line that extends through the center of a portion covered with the first sealing member in the end side of the one side portion of the recording element substrate and is parallel to the perpendicular line, and of two regions divided by the sealed portion center line in the portion where the one side portion of the recording element substrate is covered with the first sealing member, a region through which the perpendicular line extends is larger than a region through which the perpendicular line does not extend.

9. The liquid ejection head according to claim 1, wherein the first sealing member and the second sealing member are point-symmetrical with the center of gravity of the recording element substrate as a symmetrical point.

10. The liquid ejection head according to claim 1, wherein a plurality of the recording element substrates are arranged in a row, and the first sealing member and the second sealing member are each provided on each of the recording element substrates.

11. The liquid ejection head according to claim 1, wherein a plurality of the recording element substrates are arranged in a row, the first sealing member continuously covers the respective one side portions of at least two adjoining recording element substrates and the second sealing member continuously covers the respective opposite side portions of the at least two adjoining recording element substrates.

12. The liquid ejection head according to claim 1, wherein a plurality of the recording element substrates are arranged in a row, the first sealing member continuously covers the respective one side portions of all the recording element substrates and the second sealing member continuously covers the respective opposite side portions of all the recording element substrates.

13. A liquid ejection head comprising:

a recording element substrate at one side portion of which an electrode is provided;

an electric wiring board provided with wiring;

a connecting portion connecting the electrode of the recording element substrate to the wiring of the electric wiring board; and a sealing member provided across the one side portion of the recording element substrate and the electric wiring board so as to cover the connecting portion, wherein no electrode is formed at the other side portion opposite to the one side portion of the recording element substrate, and wherein a thermally curable resin member is provided at the other side portion.

14. The liquid ejection head according to claim 13, wherein the recording element substrate has a parallelogram plane shape, and a line extending through a center of gravity of the recording element substrate and perpendicularly intersecting an end side of the one side portion and a center line in an extending direction of the end side of the one side portion deviate from each other in the extending direction.

15. The liquid ejection head according to claim 13, wherein the thermally curable resin member and the sealing member are formed with the same material.

* * * * *